US007033410B2

(12) United States Patent
Hilpert et al.

(10) Patent No.: US 7,033,410 B2
(45) Date of Patent: Apr. 25, 2006

(54) CENTRIFUGAL SEPARATOR

(75) Inventors: Torsten Hilpert, Erdmannhausen (DE); Pius Trautmann, Stuttgart (DE)

(73) Assignee: Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 10/703,159

(22) Filed: Nov. 7, 2003

(65) Prior Publication Data

US 2004/0144071 A1 Jul. 29, 2004

(30) Foreign Application Priority Data

Nov. 8, 2002 (DE) ..... 102 51 940

(51) Int. Cl.
*B01D 45/14* (2006.01)

(52) U.S. Cl. ..... 55/394; 55/406; 55/DIG. 19; 96/189; 123/198 E

(58) Field of Classification Search ..... 55/385.3, 55/400, 394, 406, DIG. 19; 96/188, 189, 96/190; 123/198 E See application file for complete search history.

(56) References Cited

U.S. PATENT DOCUMENTS

| | | | | |
|---|---|---|---|---|
| 2,172,729 A * | 9/1939 | Chilton | ..... | 123/196 A |
| 4,066,552 A * | 1/1978 | Caine | ..... | 210/304 |
| 5,144,446 A | 9/1992 | Sudo et al. | | |

FOREIGN PATENT DOCUMENTS

| | | |
|---|---|---|
| DE | 966346 | 7/1957 |
| DE | 3541204 | 5/1987 |
| GB | 585695 | 2/1947 |
| WO | WO 01/36103 | 5/2001 |

OTHER PUBLICATIONS

European Search Report dated Aug. 9, 2005.

* cited by examiner

*Primary Examiner*—Robert A. Hopkins
(74) *Attorney, Agent, or Firm*—Crowell & Moring LLP

(57) ABSTRACT

A centrifugal separator for separating oil from a gas stream, particularly for venting the crankcase of an internal combustion engine, having a housing (2) in which the flow guiding means are arranged. The flow guiding means are connected to a drive shaft (3). A gas inlet (5) opens into the housing (2), and a gas outlet (6) and an oil outlet (7) lead out of the housing (2). An easily produced and functionally reliable arrangement is obtained if the housing (2) is non-rotatably mounted and an impeller (14) with blades (11) that produce a centrifugal flow is disposed in the housing (2) such that it is rotatable about the longitudinal axis (4) of the drive shaft (3).

11 Claims, 1 Drawing Sheet

FIGURE
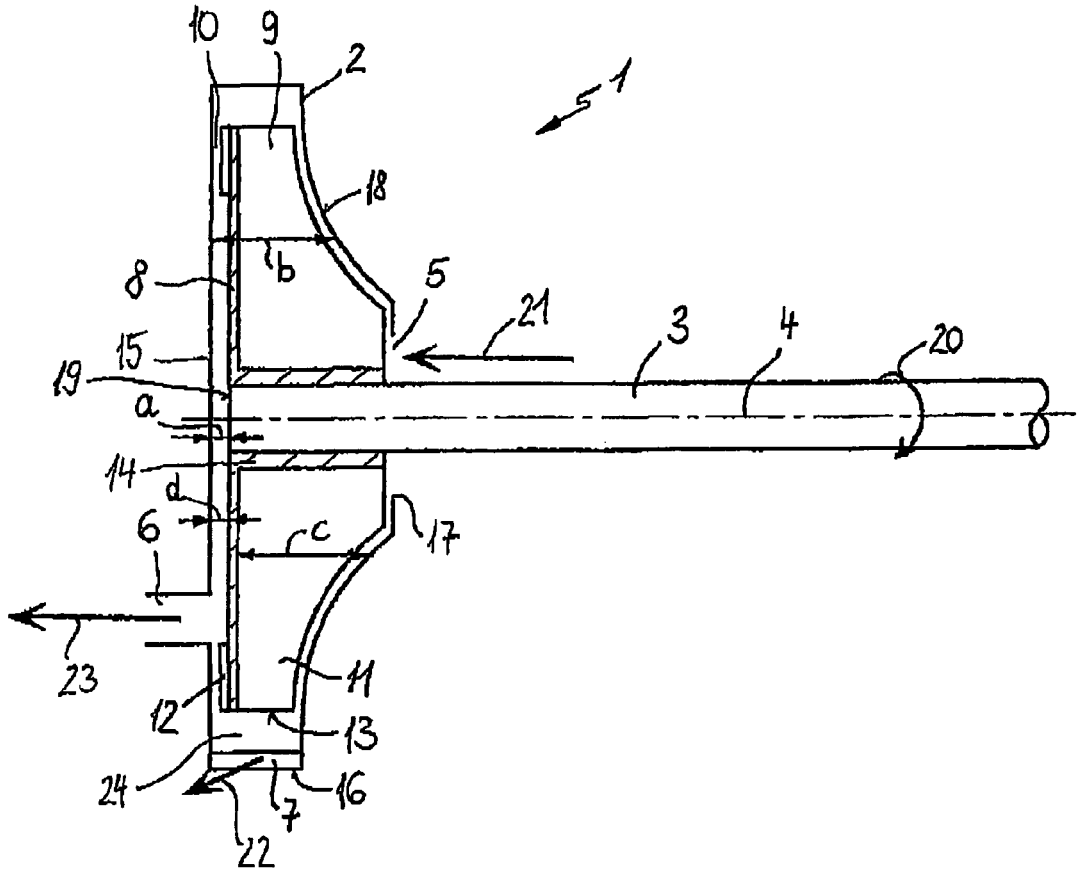

CENTRIFUGAL SEPARATOR

BACKGROUND OF THE INVENTION

The invention relates to a centrifugal separator for separating oil from a gas stream, particularly for venting the crankcase of an internal combustion engine.

Published German Patent Application No. DE 198 03 872 discloses a centrifugal separator with a housing in which baffles are arranged to redirect the flow. The centrifugal separator is firmly connected to a drive shaft by which it is driven for rotation. To separate the purified gas from the gas to be purified, it is necessary to seal the rotating housing relative to the adjacent fixed components. The required seal, however, involves the risk of leakage.

SUMMARY OF THE INVENTION

It is an object of the invention to provide an improved centrifugal separator for separating contaminants from a gas stream.

Another object of the invention is to provide an effective centrifugal separator having a simple construction.

A further object of the invention is to provide a centrifugal separator with increased functional reliability.

These and other objects are achieved in accordance with the present invention by providing a centrifugal separator for separating oil from a gas stream, said separator comprising a housing in which flow guiding means connected to a drive shaft are arranged, a gas inlet opening into the housing, and a gas outlet and an oil outlet leading out of the housing, wherein the housing is non-rotatably mounted, and an impeller with blades which cause a centrifugal flow is arranged in the housing so as to be rotatable about a longitudinal axis of the drive shaft.

According to the invention, the housing of the centrifugal separator is non-rotatably mounted. Inside the housing, an impeller equipped with blades that produce a centrifugal flow is arranged so as to be rotatable about the longitudinal axis of the drive shaft. As a result, the gas outlet formed in the housing does not need to be sealed against parts moving in relation thereto. The impeller rotates in the housing without contact, which prevents relative movements and the wear connected therewith. At the same time, a simple construction of the centrifugal separator is obtained.

Advantageously, the gas inlet is disposed at the circumference of the drive shaft between housing and drive shaft and surrounds the drive shaft completely. The gas is admitted approximately parallel to the longitudinal axis of the drive shaft. The gas inlet formed at the circumference of the drive shaft is simple to manufacture and enables a uniform inflow of the gas to be purified.

The gas inlet and the gas outlet are advantageously disposed on opposite sides of a separating wall extending perpendicularly to the longitudinal axis of the drive shaft. Blades are arranged on the side of the separating wall facing the gas inlet. The separating wall prevents a direct connection between gas inlet and gas outlet. The blades disposed on the side of the separating wall facing the gas inlet accelerate the flow in radially outward direction. As a result, oil droplets are accelerated in the direction of the outer circumference of the housing where they are deposited from the gas stream.

A further acceleration of the gas stream and, connected therewith, a pressure buildup along the housing circumference can be achieved if the width of the housing extending in the direction of the longitudinal axis of the drive shaft decreases radially outwardly in an area between the gas inlet and the outer circumference of the blades. The separating wall advantageously extends radially outwardly from the drive shaft to the outer circumference of the blades. The pressure that builds up at the circumference of the housing may be further increased by arranging blades that produce a centripetal flow on the side of the separating wall facing the gas outlet.

The drive shaft is, in particular, the camshaft or balancer shaft of an internal combustion engine. The housing is advantageously formed onto the cylinder head of an internal combustion engine.

A simple configuration of the centrifugal separator is obtained if the drive shaft ends within the housing spaced an axial distance from a housing wall. The end of the drive shaft equipped with the impeller is thus unsupported. The gas outlet is suitably offset radially inwardly in relation to the blades facing the gas outlet. The oil outlet is disposed, in particular, at the circumference of the housing.

BRIEF DESCRIPTION OF THE DRAWING

The invention will be described in further detail hereinafter with reference to an illustrative preferred embodiment shown in the accompanying drawing FIGURE, which is a cross-sectional schematic view of a centrifugal separator according to the invention.

DETAILED DESCRIPTION OF A PREFERRED EMBODIMENT

The centrifugal separator 1 illustrated in the FIGURE comprises a housing 2, which is fixed against rotation. Desirably, housing 2 may be formed on the cylinder head of an internal combustion engine. The housing 2 is largely rotationally symmetrical to the longitudinal axis 4 of a drive shaft 3.

The housing 2 has a front wall 18 that is curved in the direction of the longitudinal axis 4 of the drive shall 3. The longitudinal axis 4 simultaneously represents the axis of symmetry of the housing 2. In the area of the drive shaft 3, the front wall 18 of the housing 2 has an opening 17, particularly a circular opening, disposed concentrically to the longitudinal axis 4. The drive shaft 3 projects into the housing 2 through this opening 17. Between the drive shaft 3 and the housing 2, there is a space extending circularly between the outer circumference of the drive shaft 3 and the opening 17 and forming the gas inlet 5.

Within the housing 2, an impeller 14 is non-rotatably connected to the drive shaft 3. In the area of the shaft end 19, a separating wall 8 extending radially outwardly, perpendicular to the longitudinal axis 4 of the drive shaft 3, is formed on the impeller 14. The separating wall 8 is thus approximately disk-shaped. On the side 9 of the separating wall 8 facing the gas inlet 5, the impeller 14 has blades 11 that extend radially outwardly, particularly generally parallel to the longitudinal axis 4, and that produce a centrifugal flow. On the side facing the front wall 18, the blades 11 extend parallel to the front wall 18 of the housing 2. The separating wall 8 extends up to approximately the outer perimeter 13 of the blades 11.

An oil outlet 7 is disposed at the outer circumference 16 of the housing 2. In the illustrated embodiment, oil outlet 7 is in the shape of a slot extending parallel to the longitudinal axis 4 of the drive shaft 3. An annular space 24 is formed between the outer circumference 16 of the housing 2 and the outer perimeter 13 of the blades 11.

On the side 10 of the separating wall 8 facing the gas outlet 6, blades 12 are disposed on the impeller 14. The blades 12 extend within a narrow region radially inwardly from the outer perimeter 13 of the blades 11. The gas outlet 6 is disposed radially inside of the blades 12 relative to the longitudinal axis 4 and, in particular, directly adjoins the blades 12 in radial direction. The gas outlet 6 is thus disposed axially offset in relation to the longitudinal axis 3 of the drive shaft 4.

The shaft end 19 of the drive shaft 3 is spaced an axial distance (a) from the rear wall 15 of the housing 2 in which the gas outlet 6 is also formed. The drive shaft 3 with the impeller 14 can therefore move without contact within the housing 2. The width (b) of the housing 2, measured parallel to the longitudinal axis 4 of the drive shaft 3, decreases radially outwardly in an area between the gas inlet 5 and the outer perimeter 13 of the blades 11. The distance (d) between the separating wall 8 and the rear wall 15 of the housing is constant, whereas the distance (c) between the separating wall 8 and the front wall 18 of the housing 2 decreases radially outwardly in an area of the separating wall 8. However, the distance (c) on the side facing the gas inlet 5 is greater at any point than the distance (d) on the side 10 facing the gas outlet 6.

During operation of the centrifugal separator 1, the drive shaft 3 rotates about the longitudinal axis 4 in the direction indicated by the arrow 20. The gas to be purified flows axially into the housing 2, approximately in the direction of the arrow 21, and into the area of the impeller 14 and is accelerated radially outwardly by the rotation of the impeller 14. The pressure in the gas builds up in the annular space 24 between the outer perimeter 13 of the blades 11 and the outer circumference 16 of the housing 2. As a result, oil is separated from the gas and flows through the oil outlet 7 out of the housing 2 in the direction indicated by the arrow 22. The purified gas flows to the side 10 of the separating wall 8 facing the gas outlet 6 and from thence out of the housing 2 through the gas outlet 6 in the direction indicated by the arrow 23.

At low speeds of the drive shaft 3, the centrifugal separator 1 can be used as a pre-separator. At higher speeds, or if the diameter of the impeller 14 and the housing 2 is increased, it is also suitable for use as a final separator. In other words, by adapting the dimensions and the speed, the centrifugal separator 1 can be adapted to the required separation efficiency.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A centrifugal separator for separating oil from a gas stream, said separator comprising a housing, a gas inlet opening into the housing, and a gas outlet and an oil outlet leading out of the housing, wherein the housing is non-rotatably mounted, and an impeller with blades which cause a centrifugal flow is arranged in the housing so as to be rotatable about a longitudinal axis of a drive shaft, wherein the gas inlet and the gas outlet are arranged on opposite sides of a separating wall extending perpendicular to the longitudinal axis of the drive shaft, and blades are attached to the separating wall and disposed on a side of the separating wall facing the gas inlet, and wherein blades producing a centripetal flow are attached to the separating wall and disposed on a side of the separating wall facing the gas outlet.

2. A centrifugal separator according to claim 1, wherein the gas inlet is arranged between the housing and drive shaft around the circumference of the drive shaft and completely surrounds the drive shaft.

3. A centrifugal separator according to claim 1, wherein said housing has a width (b) extending in the direction of the longitudinal axis of the drive shaft which width decreases progressively in a radially outward direction in an area between the gas inlet and the outer perimeter of the blades.

4. A centrifugal separator according to claim 1, wherein the separating wall extends radially outwardly from the drive shaft to the outer perimeter of the blades.

5. A centrifugal separator according to claim 1, wherein the drive shaft is a camshaft or a compensating shaft of an internal combustion engine.

6. A centrifugal separator according to claim 1, wherein the housing is fanned on a cylinder head of an internal combustion engine.

7. A centrifugal separator according to claim 1, wherein the drive shaft ends inside the housing spaced an axial distance (a) from a housing wall.

8. A centrifugal separator according to claim 1, wherein the oil outlet is disposed in the circumference of the housing.

9. A centrifugal separator according to claim 1, wherein the gas inlet is connected to a crankcase of an internal combustion engine and the gas outlet to an air intake line of the engine for venting the engine crankcase.

10. A centrifugal separator for separating oil from a gas stream, said separator comprising a housing, a gas inlet opening into the housing, and a gas outlet and an oil outlet leading out of the housing, wherein the housing is non-rotatably mounted, and an impeller with blades which cause a centrifugal flow is arranged in the housing so as to be rotatable about a longitudinal axis of a drive shaft, wherein the gas outlet is offset radially inwardly relative to the blades facing the gas outlet.

11. A centrifugal separator according to claim 10, wherein the blades facing the gas outlet do not extend radially inwardly beyond an outer periphery of the gas outlet.

* * * * *